US005604957A

United States Patent [19]

Leifeld

[11] Patent Number: 5,604,957

[45] Date of Patent: Feb. 25, 1997

[54] FIBER BATT FEEDING APPARATUS FOR A FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 448,984

[22] Filed: May 24, 1995

Related U.S. Application Data

[63] Continuation-in-part of Ser. No. 172,158, Dec. 23, 1993, Pat. No. 5,479,679.

[30] Foreign Application Priority Data

Jun. 18, 1994 [DE] Germany ..... 44 21 377.8

[51] Int. Cl.[6] ..... D01G 15/40

[52] U.S. Cl. ..... 19/105

[58] Field of Search ..... 19/23, 24, 204, 19/98, 105, 296; 73/159; 33/501.02, 501.03, 501.04

[56] References Cited

U.S. PATENT DOCUMENTS

| | | | |
|---|---|---|---|
| 4,506,413 | 3/1985 | Leifeld | 19/105 |
| 4,939,815 | 7/1990 | Leifeld | 19/105 |
| 4,945,610 | 8/1990 | Leifeld . | |
| 5,014,395 | 5/1991 | Staheli et al. | 19/105 |
| 5,188,158 | 2/1993 | Gstettner et al. | 144/162 R |

FOREIGN PATENT DOCUMENTS

| | | | |
|---|---|---|---|
| 2322942 | 4/1977 | France | 19/105 |
| 1118068 | 11/1961 | Germany . | |
| 4012551 | 6/1991 | Germany . | |
| 986979 | 1/1983 | U.S.S.R. | 19/105 |
| 956146 | 4/1964 | United Kingdom . | |
| 2189519 | 10/1987 | United Kingdom . | |
| 2190109 | 11/1987 | United Kingdom | 19/105 |
| 2198461 | 6/1988 | United Kingdom . | |
| 2240996 | 8/1991 | United Kingdom . | |

*Primary Examiner*—Michael A. Neas
*Attorney, Agent, or Firm*—Spencer & Frank

[57] ABSTRACT

An apparatus for feeding a fiber batt to a fiber processing machine includes a rotatably supported feed roll; a feed table having a face portion cooperating with the feed roll and defining therewith a nip through which the fiber batt passes in an advancing direction; an arrangement rendering at least one part of a feed table surface wear resistant which directly contacts the fiber batt upon passage thereof; a movably supported elongated holding element extending spaced from, and generally parallel to the feed roll; and a plurality of sensor elements each being affixed to the holding element and each being arranged to undergo excursions as a function of thickness variations of the fiber batt passing through the nip. The sensor elements impart a displacing force on the holding element which moves to an extent representing a sum of the displacing forces. A sensor arrangement is connected to the holding element for generating a signal as a function of displacements of the holding element.

8 Claims, 4 Drawing Sheets

13
11
12
10
9
7
8
6
5
4
3
14a
15
14b
2
1
39

FIBER BATT FEEDING APPARATUS FOR A FIBER PROCESSING MACHINE

CROSS REFERENCE TO RELATED APPLICATION

This is a continuation-in-part of application No. 08/172,158 filed Dec. 23, 1993 now U.S. Pat. No. 5,479,679.

This application claims the priority of German Application No. P 44 21 377.8 filed Jun. 18, 1994.

BACKGROUND OF THE INVENTION

The invention relates to a device for feeding a fiber tuft mass (fiber batt) composed of, for example, cotton fibers, synthetic fibers or the like, to a fiber processing machine, such as a carding machine or a cleaner to prepare the fiber for spinning. The device has a fiber advancing mechanism formed of a feed roll and a cooperating feed table followed by at least one opening device such as an opening roll. The fiber advancing mechanism also serves as a batt thickness sensor. For this purpose there are provided a plurality of sensor elements which have one end attached to a rotatably or slidably supported, spring-biased holding member (summing beam) which summarizes the displacements of the individual sensor elements undergoing excursions as a function of the thickness variations of the fiber material which runs through the feed roll. The sensor elements constitute a guide assembly for the rotary or sliding motion of the spring-biased holding member. The sensor zone proper is formed at that end of each sensor element that is opposite to the end of attachment. The feed table is made of an extruded material such as aluminum or an aluminum alloy. Such a device is disclosed in the above-noted U.S. application No. 08/172,158.

SUMMARY OF THE INVENTION

It is an object of the invention to provide a further improvement of the apparatus described above.

This object and others to become apparent as the specification progresses, are accomplished by the invention, according to which, briefly stated, the apparatus for feeding a fiber batt to a fiber processing machine includes a rotatably supported feed roll; a feed table having a face portion cooperating with the feed roll and defining therewith a nip through which the fiber batt passes in an advancing direction; an arrangement rendering at least one part of a feed table surface wear resistant which directly contacts the fiber batt upon passage thereof; a movably supported elongated holding element extending spaced from, and generally parallel to the feed roll; and a plurality of sensor elements each being affixed to the holding element and each being arranged to undergo excursions as a function of thickness variations of the fiber batt passing through the nip. The sensor elements impart a displacing force on the holding element which moves to an extent representing a sum of the displacing forces. A sensor arrangement is connected to the holding element for generating a signal as a function of displacements of the holding element.

By virtue of the wear-resistant feed table surface oriented towards the fiber material, the service life of the feed table is significantly increased and the advantages of the extruded aluminum or aluminum alloy of which the feed table is made become more effective.

According to a further feature of the invention, the surface is rendered wear-resistant by providing it with a sheet metal made of steel. According to another advantageous feature of the invention, the feed table surface is plated. According to still another advantageous feature of the invention, the feed table surface is coated with an enamel, a ceramic material, titanium nitride, a hard substance or a hard metal. According to yet another feature of the invention, the feed table surface is hardened.

DESCRIPTION OF THE PREFERRED EMBODIMENTS

Figure 1:
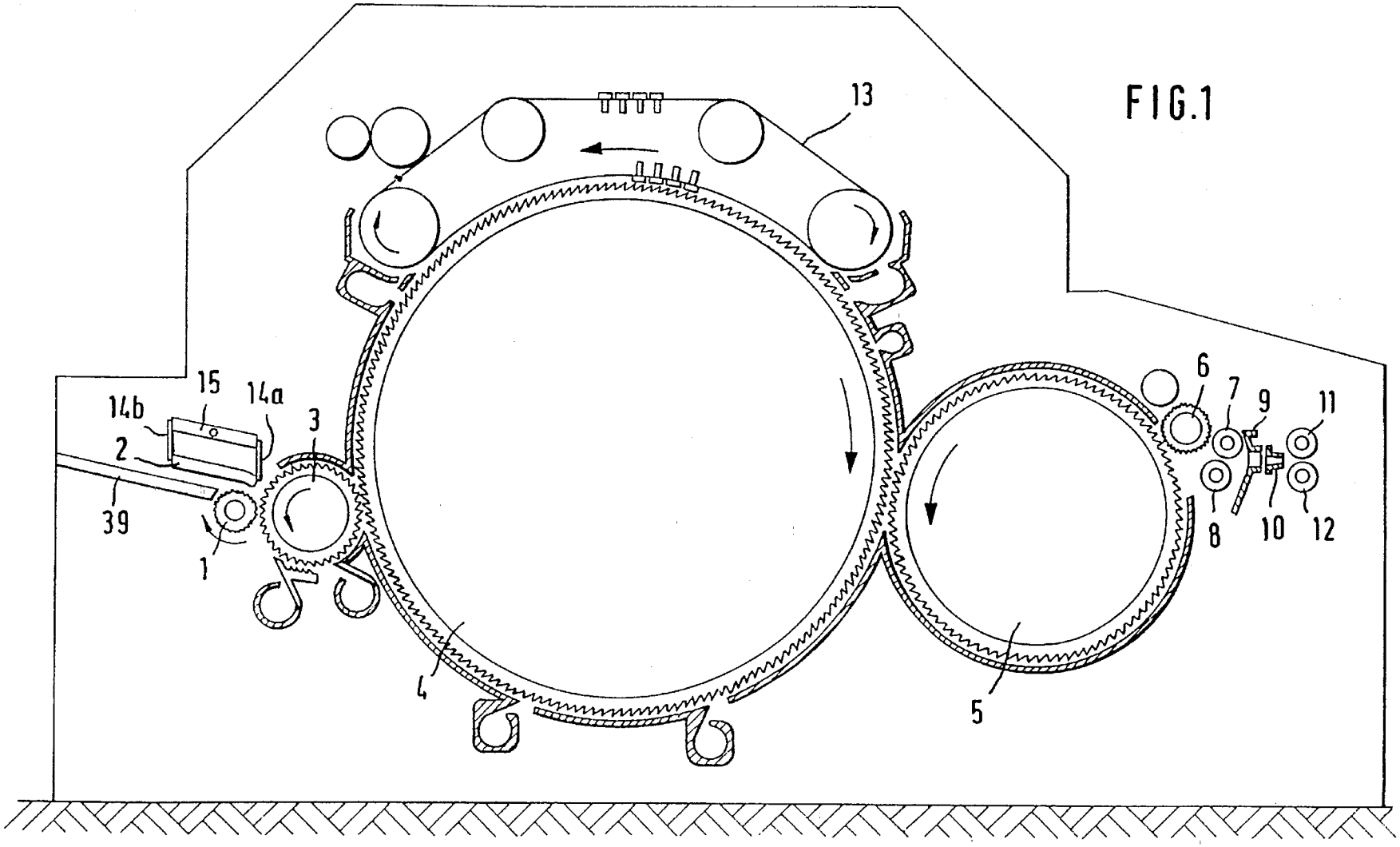
FIG. 1 is a schematic side elevational view of a carding machine having a fiber feeding device incorporating the invention.

Turning to FIG. 1, there is illustrated therein a carding machine which may be, for example, an EXACTACARD DK 760 model, manufactured by Trützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7 and 8, a web guiding element 9, a sliver trumpet 10, calender rolls 11 and 12 as well as travelling flats 13.

Figure 2:
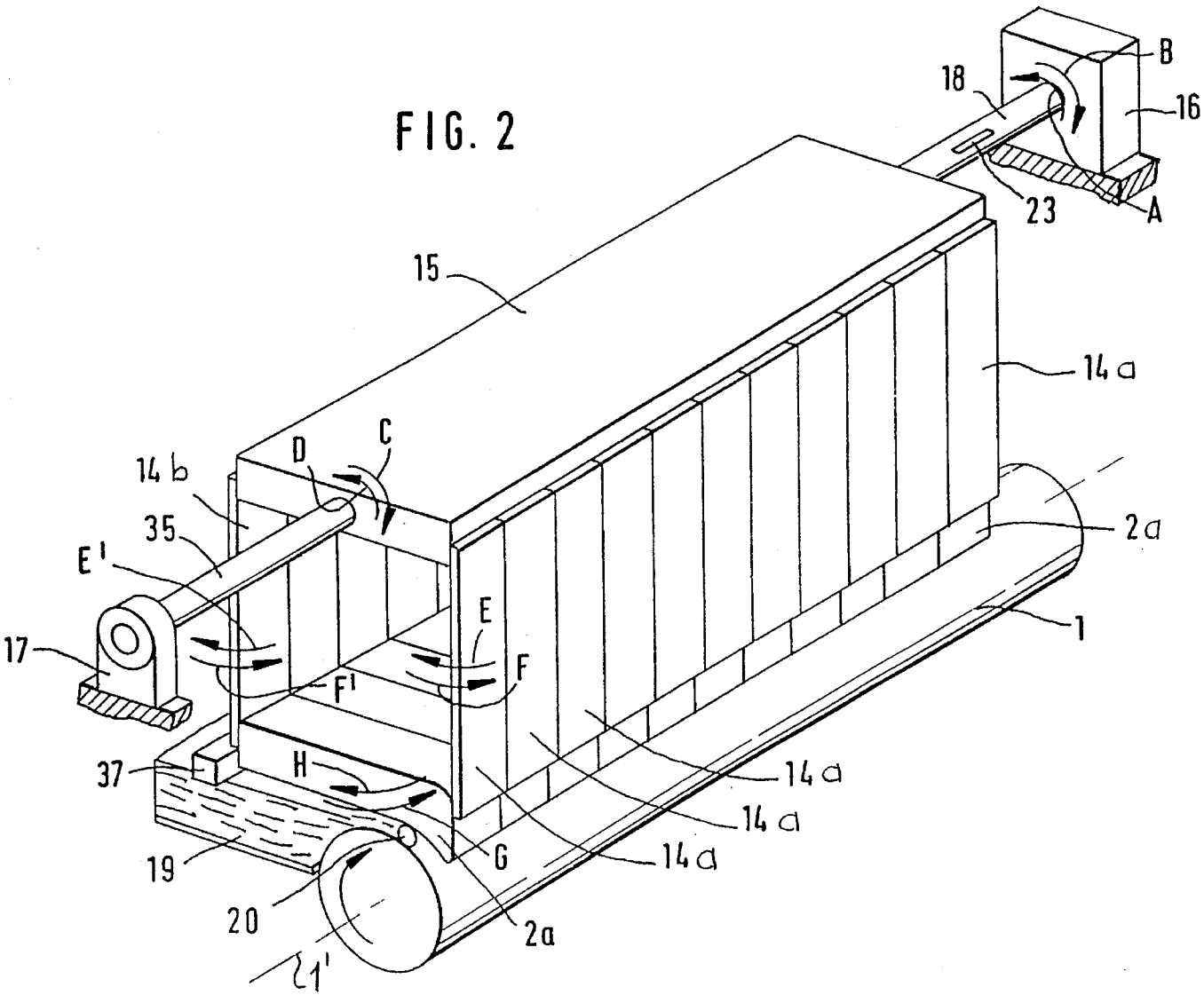
FIG. 2 is a perspective view of a fiber feeding device incorporating the invention.

Turning to FIG. 2, above the feed roll 1 there is positioned the feed table, formed have of serially arranged feed table segments **2*a*, each being connected with a common holding element 15—functioning as a summing beam—by means of an associated front leaf spring 14*a* and a rear leaf spring 14*b*. The holding element 15, whose length dimension is oriented parallel to the rotary axis 1' of the feed roll 1, is provided at one end with a torsion bar 18 fixedly held in a stationary support 16. From the opposite end of the holding element 15 a shaft 35 extends which is movably supported in a bearing 17. Between the feed table segments 2*a* and the feed roll 1 a fiber batt 19 passes which, in the zone of the clamping location (nip) between feed roll and feed table segment has a thickened part 20, causing the feed table segment 2*a* to execute an excursion in the direction of the arrow G. By virtue of such an excursion the leaf springs 14*a* and 14*b* are moved in the directions of arrows F, F'. Such an excursion leads to a rotary motion of the holding element 15 in the counterclockwise direction as indicated by the arrow D, causing a torsional deformation of the torsion bar 18 in the direction of the arrow A, whereby the expansion measuring strips 23 are deformed and such a deformation may be represented by a signal. After regulation, the torsion effect is cancelled, that is, the torsion bar 18 and the holding element 15 rotate back in the direction of arrows B and C, respectively, the leaf springs 14*a*, 14*b* swing back in the direction of the arrows E, E', and the feed table segment 2***a* moves in the direction H into its initial position.

Figure 3:
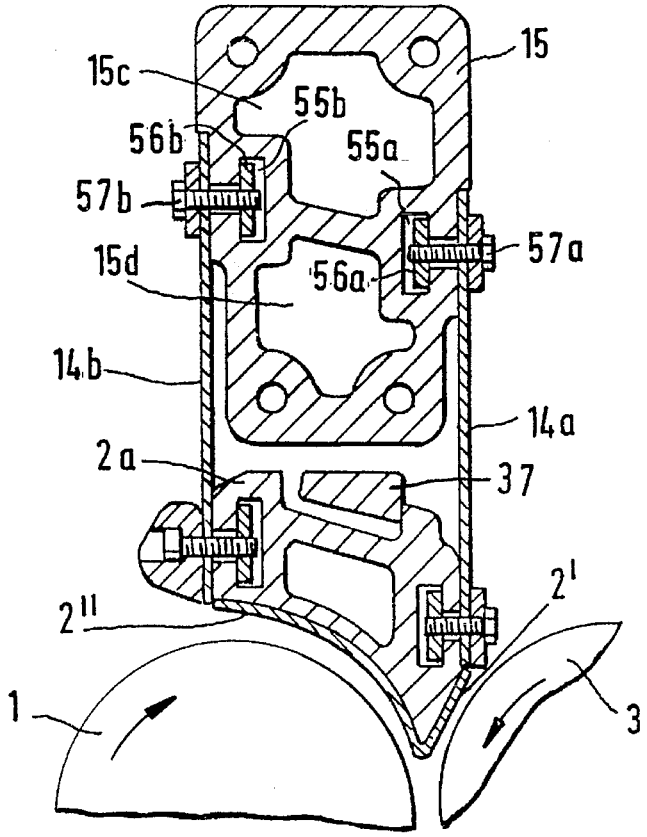
FIG. 3 is a sectional side elevational view of the fiber feeding device, incorporating a preferred embodiment of the invention.

In FIG. 3 the holding element 15 is a hollow, extruded member made for example of aluminum, or an aluminum alloy, having cavities 15*c* and 15*d*. The oscillation behavior of the feed table segments 2*a* which are also made of extruded aluminum or an aluminum alloy, is an important consideration. If the segments 2*a* were imparted a frequency close to their natural frequency, they would start oscillating with a natural frequency which would present an uncontrolled movement which would endanger their function. Consequently, the natural frequency of the segments should be as high as possible. Since the natural frequency is primarily dependent from the own flexure, the weight must be held small. For this reason aluminum is selected for the holding element 15. The selection of a light-weight material for the holding element 15 is further advantageous because the reduced weight facilitates the installing operation. Also, the selection of aluminum allows production of the shape of the beam 15 by means of an extrusion process. This eliminates the need for mechanical shaping. Between the holding element 15 and the feed table segments 2*a* an abutment bar 37 is arranged.

An abutment bar 37 is provided between the holding element 15 and the feed table segments 2*a*. The abutment bar 37 extends in a space defined by outer top grooves provided in the feed table segments 2*a*. A cooperation between a side wall of the top grooves and the abutment bar 37 limits the excursion path for each feed table segment 2*a*. In the holding element 15 thoroughgoing grooves 55*a*, 55*b* are provided which have a T-shaped cross section and each accommodates a respective fastening rail 56*a*, 56*b* for fastening the leaf springs 14*a*, 14*b* by means of screws 57*a*, 57*b*.

The surfaces 2' and 2" of the feed table (composed of feed table segments 2*a*) which cooperate with the feed roll 1 as well as the licker-in 3 and thus directly contact the fiber material, are hardened, for example, by nitrogen-hardening.

Figure 4:
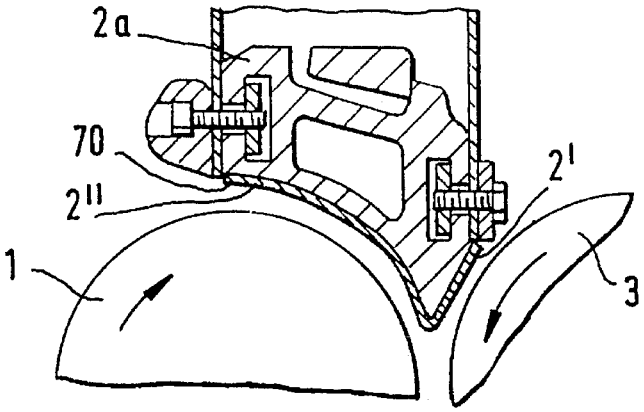
FIG. 4 is a fragmentary sectional side elevational view of the fiber feeding device of FIG. 3, incorporating another preferred embodiment of the invention.

According to the embodiment illustrated in FIG. 4, the fiber-engaging surfaces 2' and 2" of the feed table segments 2*a* are plated, for example, by means of a thin sheet metal member 70 made of high grade steel. The sheet metal member 70 may be applied to the feed table segments by gluing or by a screw connection.

Figure 5:
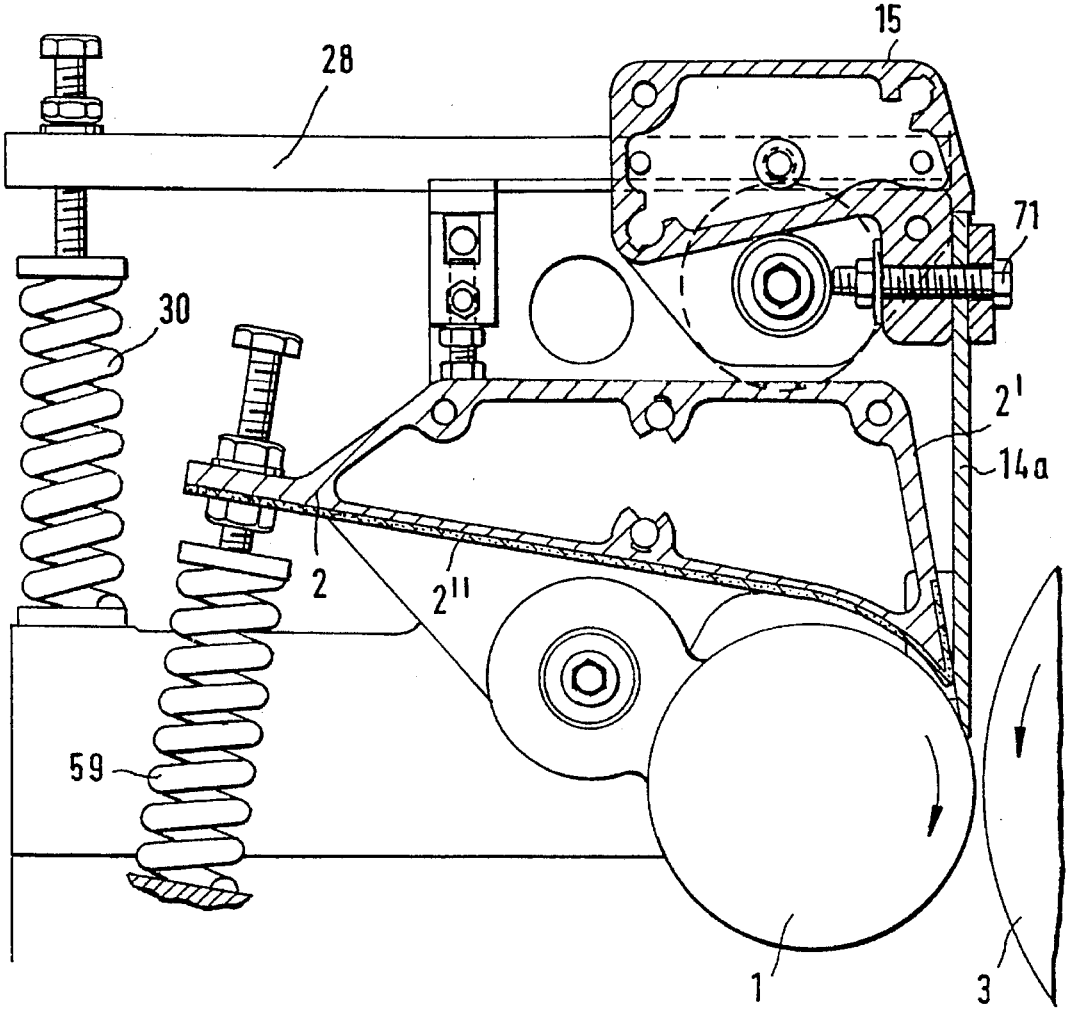
FIG. 5 is a sectional side elevational view of a fiber feeding device structured differently from that of FIGS. 3 and 4, incorporating a further preferred embodiment of the invention.

Turning to FIG. 5, in this construction a series of sensor elements 14*a* (only one is visible) such as leaf springs are provided which have an upper end secured to the holding element (summing beam) 15 by respective screws 71. The lower end of each leaf spring 14*a* directly cooperates with the feed roll 1. The feed table 2 is a one-piece component extending along the length of the feed roll 1 and is supported on the machine frame with the interposition of a coil spring 59. The forward end portion of the feed table 2 cooperates with the feed roll 1 and thus directly engages the fiber material. The spring 59 provides that the feed table may yield in case of particularly pronounced thickened portions of the running material or in case of a foreign body included in the running material. The holding element 15 in the FIG. 5 construction, similarly to the FIG. 3 construction, is arranged for performing its sensing function as described in connection with FIG. 2. A lever arm 28 is provided which is coupled to the summing bar 15 and which is supported on the machine frame with the interposition of a spring 30. The sensor fingers 14*a* also function as clamping springs for the fiber material, and during excursion, in response to thickness variations of the material, they move away from the frontal end of the feed table 2 against which they are urged by means of the respective securing devices 71.

According to the invention, an outer face 2' of the feed table 2 oriented towards and being in contact with the leaf springs 14*a* as well as the feed table face 2" oriented towards the running fiber material are provided with a wear-resistant layer, for example, a ceramic layer applied by spraying. Dependent upon requirements, it may on occasion be sufficient to provide only one of the surfaces 2' or 2" with a wear-resistant coating.

It will be understood that the above description of the present invention is susceptible to various modifications, changes and adaptations, and the same are intended to be comprehended within the meaning and range of equivalents of the appended claims.

What is claimed is:

1. An apparatus for feeding a fiber batt to a fiber processing machine, comprising (a) a rotatably supported feed roll;

(b) a feed table made of a material selected from the group consisting of extruded aluminum and an extruded aluminum alloy; said feed table having a face portion cooperating with said feed roll and defining therewith a nip through which the fiber batt passes in an advancing direction; said feed table having a surface contacting the fiber batt upon passage thereof;

(c) means for rendering at least one part of said surface of said feed table harder than said extruded material for rendering said part of said surface more wear resistant than said extruded material;

(d) a movably supported elongated holding element extending spaced from, and generally parallel to said feed roll;

(e) a plurality of sensor elements each having a securing zone and a sensing zone spaced from said securing zone; each said sensor element being affixed at said securing zone to said holding element; said sensing zone of each said sensor element being arranged for a direct engagement with the fiber batt to undergo excursions as a function of thickness variations of the fiber batt passing through said nip; said sensor elements imparting displacing forces on said holding element; said holding element being moved by said displacing forces to an extent representing a sum of said displacing forces; and (e) sensor means connected to said holding element for generating a signal as a function of displacements of said holding element.

2. The apparatus as defined in claim 1, wherein said means for rendering at least one part of said surface of said feed table harder than said extruded material comprises a sheet metal member.

3. The apparatus as defined in claim 1, wherein said means for rendering at least one part of said surface of said feed table harder than said extruded material comprises plating.

4. The apparatus as defined in claim 1, wherein said means for rendering at least one part of said surface of said feed table harder than said extruded material comprises a wear resistant coating.

5. The apparatus as defined in claim 1, wherein said means for rendering at least one part of said surface of said feed table harder than said extruded material comprises hardening.

6. The apparatus as defined in claim 1, wherein said feed table is a one-piece component.

7. The apparatus as defined in claim 1, wherein said at least one part of said surface of said feed table includes a surface portion oriented towards and being in contact with each said sensor element between the securing zone and the sensing zone thereof, whereby locations of engagement between said feed table and said sensor elements are rendered more wear resistant than said material.

8. The apparatus as defined in claim 1, wherein said means for rendering at least one part of said surface of said feed table harder than said extruded material comprises a steel layer.

* * * * *